US010905218B2

(12) United States Patent
Martinez et al.

(10) Patent No.: US 10,905,218 B2
(45) Date of Patent: Feb. 2, 2021

(54) EPILATOR

(71) Applicant: Braun GmbH, Kronberg (DE)

(72) Inventors: Pedro Sanchez Martinez, Kronberg (DE); Judith Von Dahlen, Frankfurt am Main (DE)

(73) Assignee: Braun GMBH, Kronberg (DE)

( * ) Notice: Subject to any disclaimer, the term of this patent is extended or adjusted under 35 U.S.C. 154(b) by 270 days.

(21) Appl. No.: 16/149,183

(22) Filed: Oct. 2, 2018

(65) Prior Publication Data

US 2019/0104822 A1 Apr. 11, 2019

(30) Foreign Application Priority Data

Oct. 6, 2017 (EP) ..... 17195124

(51) Int. Cl.
*A45D 26/00* (2006.01)

(52) U.S. Cl.
CPC ..... *A45D 26/0038* (2013.01); *A45D 26/0052* (2013.01); *A45D 26/0076* (2013.01)

(58) Field of Classification Search
CPC ..... A45D 26/0038; A45D 26/0052; A45D 26/0076; A45D 26/0028; B26B 19/146; B26B 19/14; B26B 19/145; B26B 19/00
See application file for complete search history.

(56) References Cited

U.S. PATENT DOCUMENTS

| | | | | |
|---|---|---|---|---|
| 9,592,614 | B2 | 3/2017 | Oosterhoff et al. | |
| 2005/0216035 | A1 | 9/2005 | Kraus et al. | |
| 2008/0209735 | A1* | 9/2008 | Haczek | B26B 19/02 30/43.91 |
| 2008/0294176 | A1* | 11/2008 | Hashiguchi | A45D 26/0028 606/133 |
| 2011/0094107 | A1 | 4/2011 | Ring et al. | |
| 2011/0308088 | A1* | 12/2011 | Brada | B26B 19/143 30/43.6 |
| 2012/0022556 | A1 | 1/2012 | Sanchez-Martinez | |

OTHER PUBLICATIONS

Sabine Ehrsam; Extended European Search Report; European Application No. 17195124.7; dated Feb. 21, 2018; European Patent Office; Munich, Germany.

* cited by examiner

*Primary Examiner* — Kathleen S Holwerda
*Assistant Examiner* — Brooke Labranche
(74) *Attorney, Agent, or Firm* — Kevin C. Johnson

(57) ABSTRACT

The present disclosure is concerned with epilator having an epilator head that has a head housing and a skin contacting unit arranged for being pivotable with respect to the head housing around a first axis and a handle arranged for being held by a user's hand, wherein the epilator head is pivotably connected with the handle and is arranged for being pivotable with respect to the handle around a second axis, the first axis and the second axis being essentially perpendicular to each other and the first axis and the second axis have a distance to each other.

18 Claims, 6 Drawing Sheets

EPILATOR

FIELD OF THE INVENTION

The present disclosure is concerned with an epilator for removing hairs from a subject's skin, where the epilator has an epilator head and a handle. It is in particular concerned with such epilators where the epilator head comprises a skin contacting unit that is arranged for being pivotable around an axis with respect to a head housing of the epilator head.

BACKGROUND OF THE INVENTION

It is generally known that many epilators, such as the Braun Silk-épil 9, have an epilator head and a handle, where the epilator head is separably connected with the handle. The epilator head comprises a skin contacting unit that is pivotable around an axis relative to a head housing.

It is now the object of the present disclosure to provide an epilator that is improved over the known epilators, in particular with respect to the handling of the epilator.

SUMMARY OF THE INVENTION

In accordance with one aspect an epilator is provided that comprises an epilator head having a head housing and a skin contacting unit arranged for being pivotable with respect to the head housing around a first axis and a handle arranged for being held by a user's hand, wherein the epilator head is pivotably connected with the handle and is arranged for being pivotable with respect to the handle around a second axis, the first axis and the second axis being essentially perpendicular to each other and the first axis and the second axis have a distance to each other.

BRIEF DESCRIPTION OF THE DRAWINGS

The present disclosure will be elucidated by a detailed description of example embodiments of epilators. In the description reference will be made to figures to visualize the concepts.

DETAILED DESCRIPTION OF THE INVENTION

Figure 1:
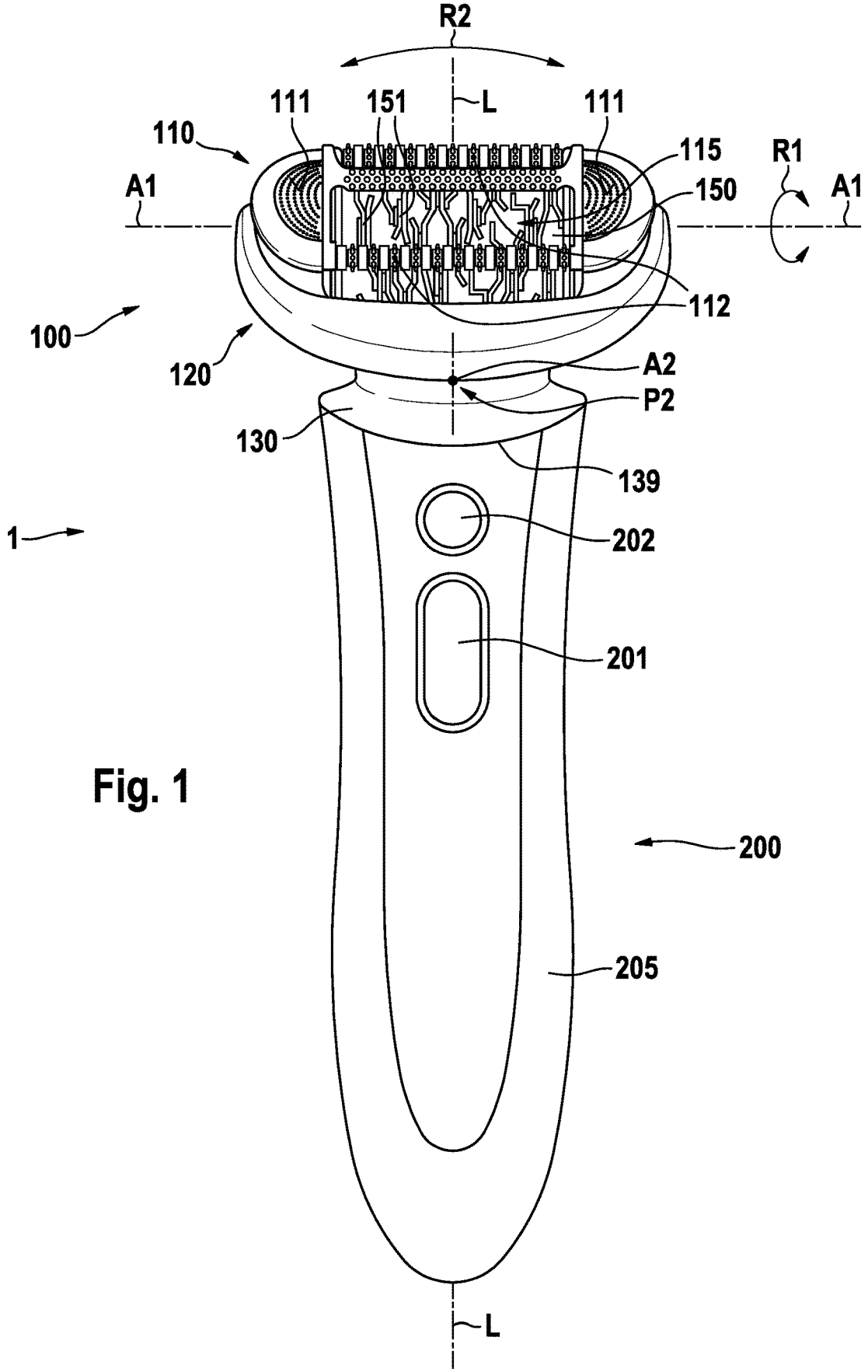
FIG. 1 is a schematic depiction of an example epilator in accordance with at least one aspect of the present disclosure.

An epilator as proposed has an epilator head that comprises a head housing and a skin contacting unit that is arranged to be pivotable around a first axis with respect to the head housing (which skin contacting unit in particular is not pivotable around any further axis with respect to the head housing, i.e. the skin contacting unit is only pivotable around the first axis with respect to the head housing). Further, the head housing carrying the skin contacting unit is arranged to be pivotable around a second axis relative to a handle of the epilator (which head housing in particular is not pivotable around any further axis with respect to the handle, i.e. the head housing is only pivotable around the second axis with respect to the handle). As will be explained in more detail further below, the epilator head may comprise a neck section for establishing a fixed connection with the handle and the head housing may then be arranged for pivoting motion relative to the neck section and the handle.

The first axis and the second axis are essentially perpendicular to each other and they have a distance to each other. The first axis may in particular be parallel to a skin contacting plane defined by the skin contacting unit (the skin contacting unit may have skin contacting elements that define the skin contacting plane). This specific structure allows a two-dimensional adaptability of the hand-held handle of the epilator with respect to the skin contacting unit (which is assumed to be in contact with the skin) so that the user can always optimally and comfortably hold the epilator and guide the skin contacting unit over the skin while maintaining optimal skin contact for efficient hair removal. While an angular range for the pivoting of the skin contacting unit around the first axis may be defined by the needs of the specific embodiment, the skin contacting unit may be arranged to pivot around the first axis in a range of ±5 degrees to ±60 degrees (where this shall mean that the skin contacting unit has a maximum deflection angle into clockwise and counterclockwise direction with respect to a center position of between 5 degrees and 60 degrees). The maximum deflection angle with respect to the center position may in particular be chosen to lie in a range of between ±10 degrees and ±30 degrees, and further in particular, a deflection angle close to ±15 degrees may be chosen.

A "first pivot point" of the first motion around the first axis located centrally in the epilator along the first axis may be closer to the skin contacting plane than a respective "second pivot point" of the second motion around the second axis located centrally in the epilator along the second axis. The first axis may in particular be parallel to the skin contacting plane and the distance between the skin contacting plane and the first axis is measured along a normal extending from the skin contacting plane and intersecting the first pivot point. The distance between the first axis and the second axis is the distance between the first pivot point and the second pivot point. Despite the distance between the first axis and the second axis, the second axis may be arranged such that it crosses the skin contacting plane when the epilator head is in a center position and further the second axis may be arranged to always cross the skin contacting plane independent of the pivot angle of the skin contacting unit relative to the head housing. At least one resilient element may be arranged to keep the head housing in a rest position relative to the handle when no external force acts on the head housing. The force that needs to be overcome to move the head housing out of the rest position may be set to a value that enables a certain tangibly perceivable hurdle, but which typically may be chosen low enough to not represent any major distraction in the usage of the device. A value around 0.5 N may be sensible, while this shall not exclude that this force value lies in a range of between 0.01 N and 2.0 N. in particular in a range of between 0.2 N and 1.0 N. The skin contacting unit and the head housing may be arranged so that a frictional force acts between them keeping the skin contacting unit in its current position despite small forces acting on the skin contacting unit such as gravitational forces, i.e. essentially no particular force value needs to be overcome to pivot the skin contacting unit relative to the head housing.

An epilation roller may be disposed within the epilator head and the skin contacting unit may have an aperture through which the epilation roller can contact the skin during operation. The epilation roller may in particular be coupled with the skin contacting unit so that the skin contacting unit and the epilation roller pivot together around the first axis, where coupled here shall not mean that a rotation of the epilation roller is inhibited but that at rest the epilation roller pivots together with the skin contacting unit (so that as a consequence a closing point of pairs of tweezers arranged on the epilation roller rotates with the skin contacting unit and remains fixed with respect to the skin contacting unit. Alternatively, the epilation roller may not be arranged to pivot together with the skin contacting unit. Independent from the connection between the epilation roller and the skin contacting unit, the epilation roller may in particular be arranged as a cylindrical epilation roller and the first axis may be arranged to coincide with the cylinder axis of the cylindrical epilation roller. As mentioned and as is generally known in the art, the epilation roller may be equipped with a plurality of pairs of tweezers arranged for clamping hairs growing on the skin and for eventually ripping those hairs out when the clamped hair is carried along by the rotating epilation roller.

It has been found that a two-dimensional adaptability of the skin contacting unit with respect to the handle without a distance between the two pivoting axes is either complex from a constructional side when the first axis and the second axis shall be close to the skin (e.g. both going through the center of an epilation cylinder that is intended to contact the skin and to clamp and remove hairs from the skin by means of a plurality of pairs of tweezers) or are not optimal from a usability point of view in case the first axis and the second axis have both a larger distance to the skin (e.g. when both axes cross each other in a neck region between the epilator head and the handle). It has thus been found that it provides a good compromise to have one adaptability axis close to the skin and the other adaptability axis being arranged with a distance, in particular with a distance such that the second axis intersects a neck region between the epilator head and the handle.

The first axis may in particular be arranged parallel to a skin contacting plane defined by the skin contacting unit, i.e. the first axis is during operation essentially parallel to the skin surface of the treated subject. The skin contacting plane may be flat or may have an essentially one-dimensional curvature, where the curvature is provided in a direction perpendicular to the direction defined by the first axis. The skin contacting unit may in particular have at least one skin contacting element defining the skin contacting plane. The distance between the first axis and the skin contacting plane may be in the range of between 2 mm and 20 mm, in particular in the range of between 5 mm and 15 mm, and further in particular in the range of between 6 mm and 12 mm.

In some embodiments, the skin contacting unit may be arranged to be pivotable without any resilient element that would bias the skin contacting unit into a rest position. Pivoting may then be enforced by small forces overcoming e.g. a friction force between the skin contacting unit and the housing of the epilator head. Such a friction force may be chosen so that the skin contacting unit stays in the current position as long as no force is applied that overcomes the friction force. But the force is chosen so low that the user does not notice a particular hurdle in pivoting the head housing relative to the skin contacting unit. Alternatively, a resilient element (e.g. a spring element) may be arranged between the head housing and the skin contacting unit, which resilient element returns the skin contacting unit into a center or rest position if no external forces act on the skin contacting unit.

The distance between the first axis and the second axis (where here the term "distance" is to be understood as the distance between the first and second pivot point as was explained in a previous paragraph) may be in the range of between 5 mm and 50 mm, in particular in the range of between 10 mm and 40 mm, and further in particular in the range of between 15 mm and 30 mm.

The skin contact plane defined by the at least one skin contact element of the skin contacting unit and the second axis may be arranged such that the second axis intersects the skin contacting plane at least for one pivot angle or a sub-range of possible pivot angles that can be achieved by the skin contacting unit and in particular the second axis may be oriented such that the second axis always crosses the skin contacting plane for any possible pivot angle of the skin contacting unit. A thus oriented second axis tends to improve the use experience of the user when using the device as it supports the comfort of the hand guiding the handle. The second axis may be arranged to intersect the skin contacting plane at an angle in the range of between 20 degrees and 40 degrees when the skin contacting unit is in its center position. The intersection angle may in particular be chosen to be about 30 degrees for the center position of the skin contacting unit.

The epilator may comprise at least one resilient element (e.g. a spring element such as a coil spring, a leaf spring etc.) that biases the head housing into a rest or central position with respect to the handle. The epilator head may be pivotable around the second axis in an angular range of ±45 degrees or less, e.g. ±30 degrees or less, ±25 degrees or less, ±20 degrees or less, ±15 degrees or less, ±10 degrees or less with respect to the center position. One or more stopper elements may be provided at a position fixed with respect to the handle to limit the pivoting range of the head housing relative to the handle. The stopper element(s) may be provided at a neck section of the epilator head or at the handle. Alternatively and/or additionally, at least one further stopper element may be arranged at the head housing to limit the pivoting angle range of the skin contacting unit relative to the head housing.

The epilator head may be repeatedly detachable from the handle and again attachable to the handle. In such embodiments, the handle may comprise a drive shaft for transferring a motion from the handle to the epilator head to drive an epilation roller or the like into motion. The epilator head may comprise a motion receiver element for coupling with the drive shaft. It is contemplated in some embodiments that the motion receiver element comprises a first coupling element and the drive shaft comprises a second coupling element that together form a separable Cardan joint (also called a universal joint) in the attached state. The Cardan joint then can realize the above mentioned second pivot point for the pivoting motion of the head housing relative to the handle, i.e. the second axis would then intersect the pivot point defined by the Cardan joint.

The Cardan joint may comprise a first coupling element that may in particular be realized by an at least partially hemispherical central portion from which at least partially hemispherical central portion four axle projections extend, which four axle projections define two perpendicular axes that cross each other in the pivot point defined by the Cardan joint. The Cardan joint may comprise a second coupling element that has a hollow cylindrical portion for receiving the hemispherical center portion of the first coupling element. The second coupling element may further have four elongated slits that extend from a bottom portion of the hollow cylinder along a direction parallel to the cylinder axis of the hollow cylinder, which four elongated slits are arranged to receive the four axle projections of the first coupling element so that the axles are in particular almost play-free received in the slots with respect to a circumferential direction. While a Cardan joint may generally allow for a free rotation of the head housing relative to the handle, the movement of the head housing relative to the handle may be restricted to a pivoting motion around only the second axis, which second axis then intersects the pivot point defined by the Cardan joint. The epilator head may then comprise a guiding structure for inhibiting motion of the head housing around other axes than the second axis. The head housing may in particular be kept in a rest position by means of a resilient element such as a spring element that biases the head housing into the rest position. The rest position may in particular be a center position so that the head housing can pivot around the second axis by the same maximum deflection angle in clockwise and counterclockwise direction.

The epilator in accordance with the present proposal may comprises at least one lock element for mechanically inhibiting at least one of the pivot motion of the skin contacting unit with respect to the head housing and the pivot motion of the head housing with respect to the handle. The lock element may comprise a protrusion portion or arm portion that interlocks with a respective portion of the skin contacting unit or the neck section when the lock element is activated (e.g. by depressing the lock element or by sliding it into another position) in order to inhibit at least one of the two pivoting motions. A user can then switch off the adaptation possibilities of the epilator at will if the user finds this appropriate. The epilator may comprise two lock elements, where each lock element serves to inhibit one assigned pivoting motion.

FIG. 1 is a depiction of an example epilator 1 in accordance with the present disclosure. The epilator 1 comprises an epilator head 100 and a handle 200. The epilator head 100 as shown comprises a skin contacting unit 110 that is mounted at a head housing 120 so as to be pivotable around a first axis A1 relative to the head housing 120. The skin contacting unit 110 has skin contacting elements such as skin contacting surfaces 111 and skin contacting rollers 112 that together define an essentially flat skin contacting plane. An epilation roller 150 is arranged in an aperture 115 of the skin contacting unit 110 and comprises a plurality of pairs of tweezers 151. The epilation roller 150 is mounted at the head housing 120 so as to be rotatable around the first axis A1. The epilation roller 150 is in particular arranged for driven rotation around the first axis and in operation a motor disposed in the handle provides a rotating motion via a drive shaft, which motion is transferred to the epilation roller 150 via a gear disposed in the epilator head 100. The epilator head 100 further comprises a neck portion 130 that is detachably attached to the handle 200. A mechanical de-lock element (not shown) may be provided to release the neck portion 130 from its fixation at the handle 200. When attached, then the neck portion 130 remains fixed with respect to the handle 200. Hence, the epilator head 100 and the handle are here repeatedly detachable from each other and again attachable to each other. This allows changing the epilator head 100 and enables cleaning inner parts of the epilator head 100. A separation line 139 indicates where the epilator head 100 and the handle 200 can be separated.

The handle 200 is structured to be graspable by a user's hand. The handle 200 may comprise an ON/OFF switch 201 and optionally also a light source 202 (such as an LED) for, e.g., illuminating the skin area to be treated. These elements are optional and other embodiments are contemplated were none or only one or some elements are realized. E.g. instead of a mechanical ON/OFF button 211, the epilator may comprise a capacitive sensor for detecting whether a user's hand has grasped the handle and may thus automatically switch the epilator into a wake state. A further capacitive sensor for detecting whether the epilator head is close to the skin may then start a motor to drive the epilation roller into motion.

The handle 200 defines a longitudinal axis L that generally extends in a length direction of the handle 200. The longitudinal axis L is introduced for explanatory reasons. As will be explained further below, the longitudinal axis L extends through a second pivot point P2 around which the head housing 110 can pivot relative to the handle 200 around a second axis A2 as is indicated by double arrow R2. The neck portion 130 provides a tapering so that the wider head housing 120 can easily pivot around the second axis A2. Such a design provides a structure that allows the top part of the epilator head 100 (i.e. head housing 120 and skin contacting unit 110) to move relative to the handle 200 and the fixedly attached neck portion 130. Obviously, this is just one potential design and other designs without such a tapering neck portion 130 are contemplated as well.

Figure 2:
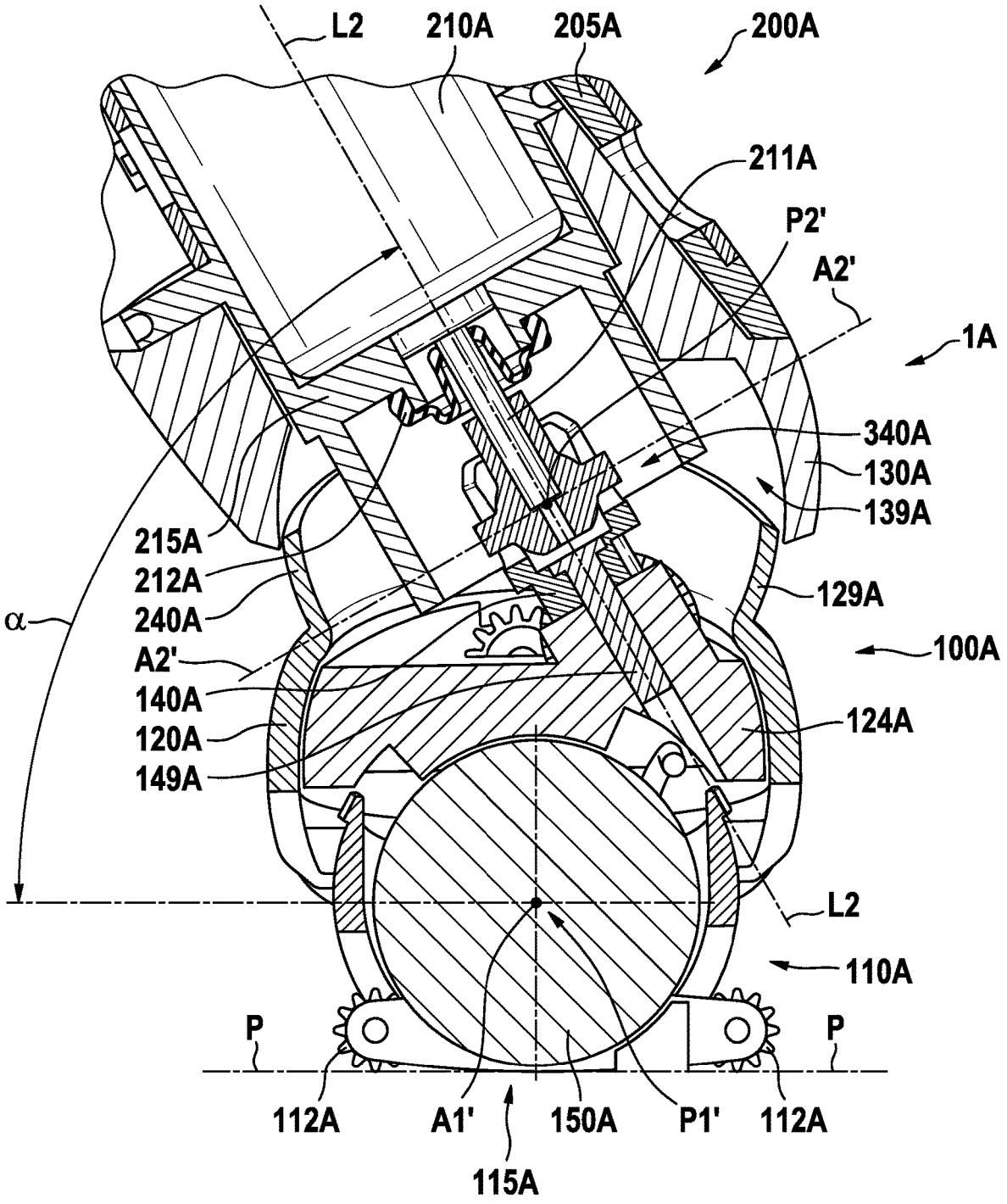
FIG. 2 is a partial cross-section of an example embodiment of an epilator in accordance with the present disclosure showing an epilator head and a portion of the handle.

FIG. 2 is a cross section though an example epilator 1A in accordance with the present disclosure. Only a head portion of the epilator 1A is shown. The epilator 1A comprises an epilator head 100A and a handle 200A. The epilator head 100A comprises a skin contacting unit 110A, a head housing 120A, and a neck portion 130A. An epilation roller 150A is disposed in a cavity in the epilator head 100A and is mounted for driven motion around a first axis A1'. The cross section extends along a center plane through the epilator 1A so that the point of the first axis A1' shown here coincides with the first pivot point P1'. The skin contacting unit 110A comprises skin contacting elements of which here two skin contacting rollers 112A are shown. The skin contacting elements define a skin contacting plane P. The epilation roller 150A is arranged in an aperture 115A of the skin contacting unit 110A and can thus contact the skin of a user, in particular can grasp hairs growing on the skin to rip them out. No details of the construction of the epilation roller 150A are shown but it shall be understood that the epilation roller 150A comprises structures serving to rip out hairs (e.g. a plurality of pairs of tweezers 151 as indicated in FIG. 1).

The skin contacting unit 110A is arranged for pivoting motion around the first axis A1' relative to the head housing 120A. The head housing 120A itself is mounted for pivoting motion around a second axis A2' with respect to the handle 200A. The epilator head 100A further comprises a neck portion 130A that is detachably connected with a handle housing 205A of the handle 200A. In the attached state, the neck portion 130A is fixed at the handle 200A via mechanical fixation structures, but the fixation is in particular realized as a releasable fixation so that the epilator head 100A can be repeatedly detached from the handle 200A and attached to the handle 200A again, e.g. to clean the epilator head 100A. The head housing 120A comprises here a neck wall 129A that may be cylindrically or spherically shaped. The neck portion 130A defines a hollow 139A into which the neck wall 129A can immerse when the head housing 120A moves around the second axis A2' relative to the handle 200A and the neck portion 130A. The neck wall 129A may in particular be sized such that it is always immersed in the hollow 139A independent from the pivoting angle around the second axis A2' so that dust and debris can essentially not enter into the hollow 139A. A gear block 124A is mounted inside of the head housing 120A. A first coupling element 140A of a separable Cardan joint 340A is movably mounted at the gear block 124A. The first coupling member 140A is mounted by means of an axle 149A around which the first coupling member 140A can freely rotate. The first coupling member 140A is coupled with gear elements to transfer the motion provided from a drive shaft 211A of a motor 210A disposed in the handle 200A to the epilation roller 150A to drive the epilation roller 150A into rotation around the first axis A1'.

Figure 3A:
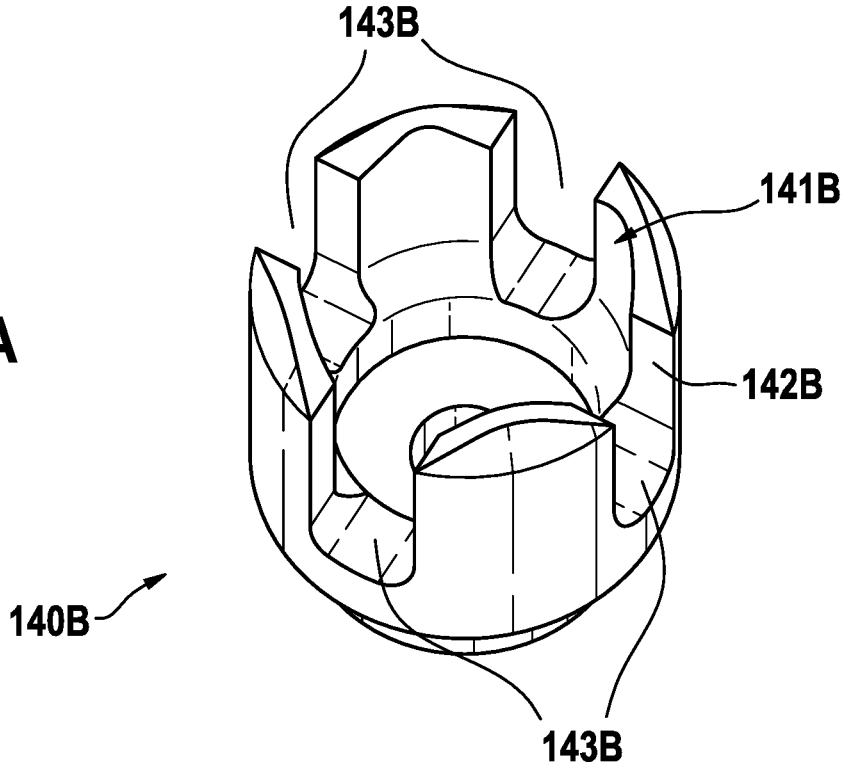
FIG. 3A is a depiction of an example embodiment of a first coupling element forming a separable Cardan joint.
Figure 3B:
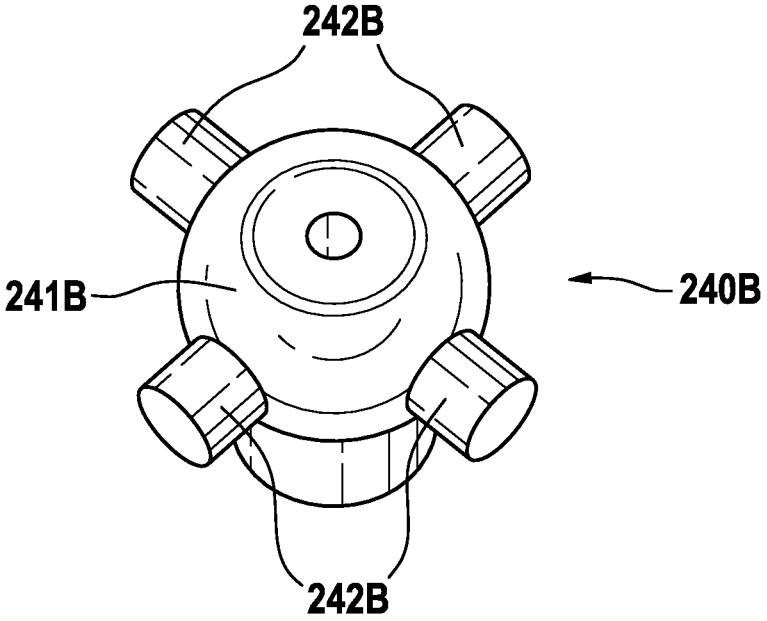
FIG. 3B is a depiction of an example embodiment of a second coupling element forming a separable Cardan joint.

The handle 200A comprises the motor 210A, which is mounted at a mounting structure 215A that itself is connected with the handle housing 205A. The mounting structure 215A comprise a through hole through which the drive shaft 211A extends. As shown, the drive shaft 211A may be water-tightly sealed against the mounting structure 215A by means of a bellow seal 212A to enable usage of the epilator 1A in a wet environment. A second coupling element 240A of the separable Cardan joint 340A is fixedly attached to the drive shaft 211A. Reference is made to FIGS. 3A and 3B and the respective following description for details of an embodiment of the separable Cardan joint.

FIGS. 3A and 3B are depictions of an example embodiment of a first coupling element 140B (FIG. 3A) and a second coupling element 240B (FIG. 3B) of a separable Cardan joint shown in a detached state. The first and second coupling elements 140B, 240B are arranged to form a Cardan joint when attached to each other as was discussed before, in particular with reference to FIG. 2. It had been described that the first coupling element 140B may be coupled with a motion receiver element (e.g. a gear wheel) of the epilator head and the second coupling element 240B may be fixedly disposed at a free end of a drive shaft provided at the handle. The motion receiver element and the drive shaft are here not shown for sake of simplicity. It is obvious that it is irrelevant whether the male or the female portion of the Cardan joint is provided at the motion receiver element. The head housing of the epilator head is here described as being pivotable with respect to the handle around only one axis (the second axis), the transfer of motion from the drive shaft to the epilation roller must be enabled at all pivot positions of the head housing relative to the handle. A Cardan joint enables this motion transfer.

The first coupling element 140B comprises a hollow cylinder 141B that is open at a free end for receiving the second coupling element 240B. The hollow cylinder 141B has a cylinder wall 142B that comprises four elongated slots 143B that extend in cylinder axis direction and are arranged with 90 degree offsets. The elongated slots 143B are open at the free end of the hollow cylinder 141B. The cylinder wall 142B may be chamfered at the sides of the slots 143B in circumferential direction, as is shown in FIG. 3A, to improve the clutching of the first and second coupling elements 140B, 240B in the attachment process. The cylinder wall 142B may also have a chamfer in radial direction.

The second coupling element 240B has a hemispheric center portion 241B that is intended to be received inside of the hollow cylinder 141B when the Cardan joint is joined (i.e. in the attachment process when the epilator head is attached onto the handle). The hemispheric center portion 241B has here a flattened top, which is not limiting the function of the Cardan joint as the head housing has only a limited pivoting range around its center position. The hemispheric center portion 241B fits essentially play-free into the hollow cylinder 141B. Four axles 242B are arranged with a 90 degrees offset to each other, which four axles 242B project from the bottom part (the "equator") of the hemispheric center portion 241B so that the axles 242B can slide into the slots 142B of the first coupling element 140B in the attachment process. The axles 242B fit essentially play-free into the slots 142B with respect to a circumferential direction.

Figure 4A:
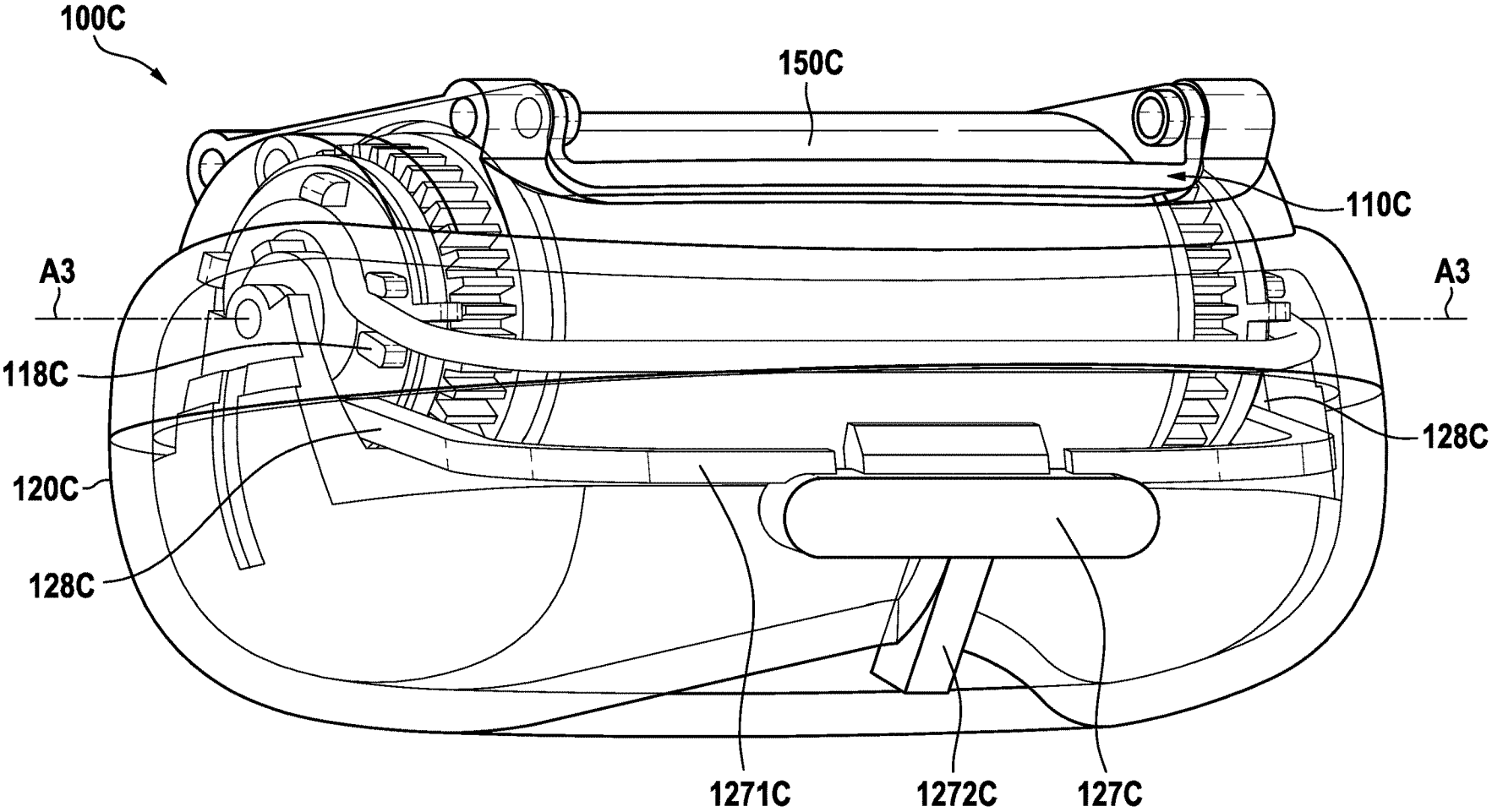
FIG. 4A is a depiction of an example embodiment of an epilator head in accordance with at least one aspect of the present disclosure having a mechanical lock element for inhibiting at least one of the pivoting motions, where the lock element is shown in a first position in FIG. 4A.
Figure 4B:
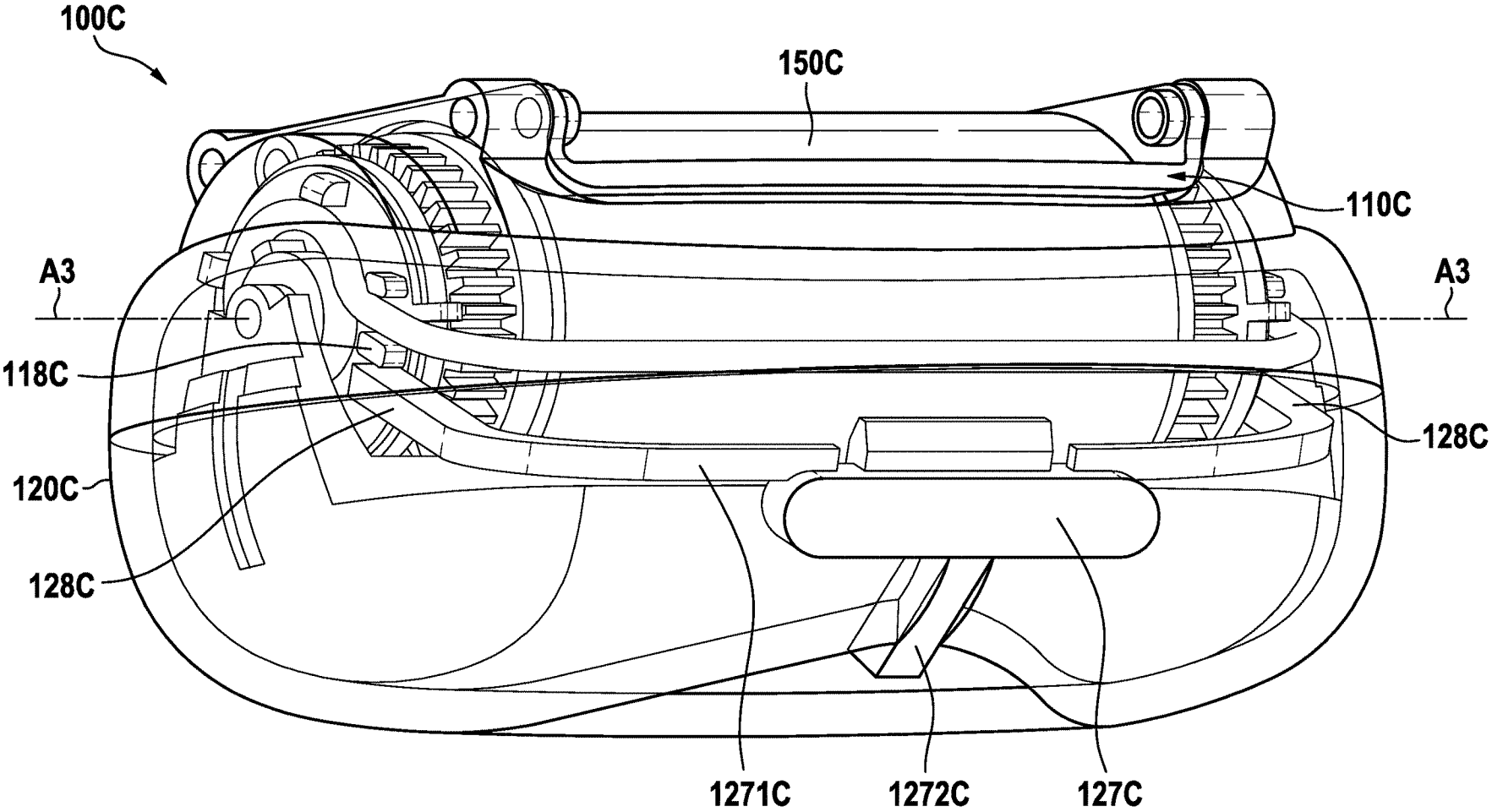
FIG. 4B is a depiction of an example embodiment of an epilator head in accordance with at least one aspect of the present disclosure having a mechanical lock element for inhibiting at least one of the pivoting motions, where the lock element is shown in and a second position in FIG. 4B.

FIGS. 4A and 4B are schematic depictions of a backside of an example epilator head 100C, the epilator head 100C having a head housing 120C and a skin contacting unit 110C that is generally arranged for pivoting motion with respect to the head housing 120C around an axis A3. The epilator head 100C comprises a lock element 127C arranged at the backside of the head housing 120C. The lock element 127C is here arranged to inhibit the pivoting motion of the skin contacting unit 110C relative to the head housing 120C and simultaneously to inhibit the pivoting motion of the head housing 120C relative to the handle. The lock element 127C is arranged as a mechanical switch that can be moved between two switch positions. The lock element 127C has a generally U-shaped arm 1271C and a projection 1272C. The U-shaped arm 1271C has front arm portions 128C. In a first position as shown in FIG. 4A, the front arm portions 128C do not engage with a stopper element 118C provided at the epilation roller 150C and thus the pivoting motion of the skin contacting unit 110C, which is pivotably coupled with the epilation roller 150C, relative to the head housing 120C is enabled. In the same first position, the projection 1272C of the lock element 117C is not engaging with a stopper element (not shown) of the handle. In a second position of the lock element 127C as shown in FIG. 4B, the front arm portions 128C engage with stopper elements 118C and thus a pivoting motion of the skin contacting unit 110C is inhibited and simultaneously the projection 1272C engages with the mentioned stopper element arranged at the housing so that the pivoting motion of the head housing 120C relative to the handle is inhibited. In alternative embodiments, the arm 1271C or the projection 1272C is discarded with and, respectively, only one of the pivoting motions will be inhibited by the lock element 127C. In some embodiments, two separate lock elements are provided to allow independent inhibition of the two pivoting motions.

Figure 5:
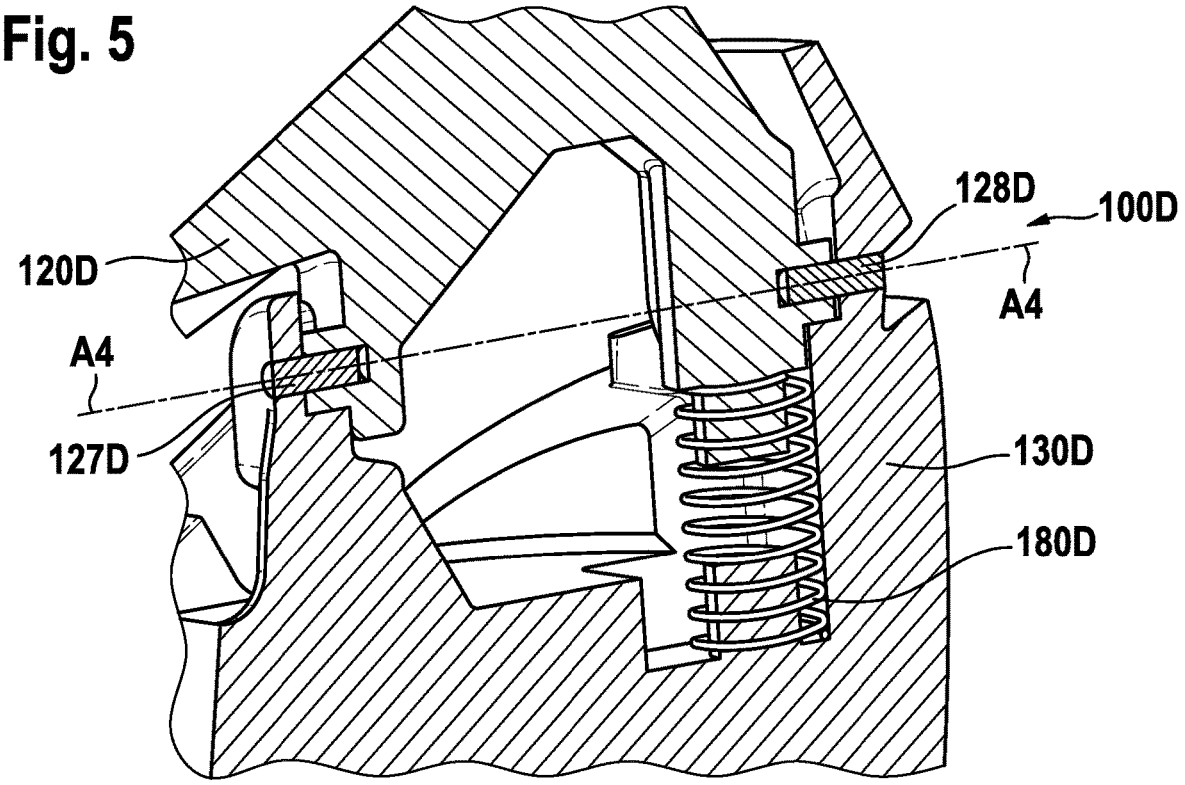
FIG. 5 is a cross-sectional view through a neck portion of an epilator head, where the upper portion is arranged to be pivotable with respect to the lower portion and a spring element keeps the upper portion in a center rest position.

FIG. 5 is a cross sectional cut through a portion of an epilator head 100D of which only a portion of a neck section 130D and a portion of a head housing 120D is shown. The head housing 120D is mounted at the neck portion 130D via two axles 127D, 128D to enable a pivoting motion of the head housing 120D with respect to the neck portion 130D around an axis A4 (which is the second axis of the epilator). A resilient element 180D is arranged between the neck portion 130D and the head housing 120D. The resilient element 180D is here realized as a coil spring. The coil spring is pre-stressed and applies a centering force. A pivoting motion of the head housing 120D will further compress the coil spring, so that the shown center position of the head housing 120D is maintained until a force acts onto the head housing overcoming the spring force. The shown design is just one simplified and non-limiting example and many other designs to realize the centering function can be contemplated by a skilled person.

In one aspect of the present disclosure, an epilator is provided that comprises an epilator head having a head housing and a handle arranged for being held by a user's hand; wherein the epilator head and the handle are repeatedly detachable from each other and attachable to each other and wherein the epilator head comprises a first coupling member of a separable Cardan joint and the handle comprises a second coupling member of the separable Cardan joint.

The separable Cardan joint may in particular be realized as was discussed for the previous embodiments. The coupling member of the separable Cardan joint located at the handle may in particular be arranged at a free end of an axle for transmitting a rotational motion around the longitudinal axis of the axle from the handle to the epilator head.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An epilator comprising:

an epilator head having a head housing and a skin contacting unit mounted at the head housing and arranged for being pivotable with respect to the head housing around a first axis; and a handle arranged for being held by a user's hand;

wherein the head housing of the epilator head is arranged to be pivotable with respect to the handle around a second axis, the first axis and the second axis being essentially perpendicular to each other and the first axis and the second axis having a distance to each other;

wherein the skin contacting unit has skin contacting elements that define a skin contacting plane, and the second axis always crosses the skin contacting plane irrespective of a pivot angle of the skin contacting unit relative to the head housing.

2. The epilator in accordance to claim 1, wherein at least one resilient element is provided for keeping the head housing in a defined rest position.

3. The epilator in accordance to claim 1, wherein the skin contacting unit is arranged to be pivotable around the first axis within an angular amplitude in the range of between about ±5 degrees to about ±60 degrees around a center position.

4. The epilator in accordance to claim 1, wherein the skin contacting unit is arranged to be pivotable around the first axis within an angular amplitude in the range of between about ±10 degrees to about ±30 degrees.

5. The epilator in accordance to claim 1, wherein an angle between the second axis and the skin contacting plane is in a range of between about 20 degrees and about 40 degrees when the skin contacting unit is in a center position.

6. The epilator in accordance to claim 1, wherein an angle between the second axis and the skin contacting plane is about 30 degrees when the skin contacting unit is in a center position.

7. The epilator in accordance to claim 1, wherein the epilator head comprises an epilation roller arranged for driven rotational motion around the first axis.

8. The epilator in accordance to claim 7, wherein the epilation roller is coupled with the skin contacting unit and pivots together with the skin contacting unit around the first axis.

9. The epilator in accordance to claim 1, wherein the epilator head comprises at least one lock element for mechanically inhibiting at least one of a pivot motion of the skin contacting unit with respect to the head housing and a pivot motion of the head housing with respect to the handle.

10. The epilator in accordance to claim 1, wherein the epilator head comprises a neck portion that is connected with the handle to establish a separable but otherwise fixed connection.

11. The epilator in accordance to claim 10, wherein the head housing comprises a cylindrically or spherically shaped neck wall, wherein the neck wall is arranged to immerse into a hollow defined by the neck portion when the head housing pivots around the second axis.

12. The epilator in accordance to claim 1, wherein the epilator head comprises a gear arranged to convert a rotational motion provided via a drive shaft into a rotational motion around an axis being essentially perpendicular to the longitudinal axis of the handle.

13. The epilator in accordance to claim 1, wherein the second axis is essentially perpendicular to the longitudinal axis of the handle.

14. The epilator in accordance to claim 1, wherein the first axis is arranged to be closer to the skin contacting plane than the second axis, wherein the distance between the skin contacting plane and the second axis is measured along a normal extending from the skin contacting plane, wherein the normal intersects a pivot point around which the head housing of the epilator head is pivotably arranged with respect to the handle.

15. The epilator in accordance to claim 1, wherein the first axis is essentially perpendicular to the longitudinal axis of the handle and/or the first axis is parallel to the skin contacting plane.

16. An epilator comprising:

an epilator head having a head housing and a skin contacting unit mounted at the head housing and arranged for being pivotable with respect to the head housing around a first axis; and a handle arranged for being held by a user's hand;

wherein the head housing of the epilator head is arranged to be pivotable with respect to the handle around a second axis, the first axis and the second axis being essentially perpendicular to each other and the first axis and the second axis having a distance to each other;

wherein the epilator head is repeatedly detachable from and attachable to the handle and comprises a first coupling element of a separable Cardan joint and the handle comprises a second coupling element of the separable Cardan joint, wherein the Cardan joint defines a pivot point and the second axis extends through the pivot point.

17. The epilator in accordance to claim 16, wherein one of the first and second coupling elements of the Cardan joint has an essentially hemispherical central portion from which four axle projections extend, which axle projections define two perpendicular axes.

18. The epilator in accordance to claim 17, wherein one of the first and second coupling elements of the Cardan joint comprises a hollow cylinder portion for accommodating the hemispherical central portion, wherein the hollow cylinder portion comprises a wall with four elongated slots open on a receiving side of the hollow cylinder portion for accommodating the axle projections.

* * * * *